US011965718B2

(12) United States Patent
Contri

(10) Patent No.: US 11,965,718 B2
(45) Date of Patent: Apr. 23, 2024

(54) BULLETPROOF PROTECTION ELEMENTARY COMPONENT

(71) Applicant: ELET.CA S.r.l. con Socio Unico, Mantua (IT)

(72) Inventor: Alberto Contri, Florence (IT)

(73) Assignee: ELET.CA S.R.L. CON SOCIO UNICO, Mantua (IT)

( * ) Notice: Subject to any disclaimer, the term of this patent is extended or adjusted under 35 U.S.C. 154(b) by 0 days.

(21) Appl. No.: 18/078,310

(22) Filed: Dec. 9, 2022

(65) Prior Publication Data

US 2023/0106261 A1 Apr. 6, 2023

Related U.S. Application Data

(63) Continuation of application No. 17/062,894, filed on Oct. 5, 2020.

(30) Foreign Application Priority Data

Oct. 7, 2019 (EP) ..... 19425071
Oct. 7, 2019 (IT) ..... 102019000018038

(51) Int. Cl.
*F41H 5/04* (2006.01)
*F41H 1/02* (2006.01)
*F41H 5/013* (2006.01)

(52) U.S. Cl.
CPC ..... *F41H 5/0492* (2013.01); *F41H 1/02* (2013.01); *F41H 5/013* (2013.01); *F41H 5/0435* (2013.01)

(58) Field of Classification Search
CPC ..... F41H 5/0492; F41H 5/013; F41H 5/0435; F41H 1/02
USPC ..... 89/36.02
See application file for complete search history.

(56) References Cited

U.S. PATENT DOCUMENTS 6,035,438 A * 3/2000 Neal ..... F41H 5/0464 428/101
7,685,922 B1 * 3/2010 Martin ..... F41H 5/0428 89/36.01
8,434,396 B1 * 5/2013 Wiley ..... F41H 5/013 89/36.01

(Continued)

FOREIGN PATENT DOCUMENTS

EP 1864075 A1 12/2007
EP 1980813 A2 10/2008
WO 2006103431 A1 10/2006

OTHER PUBLICATIONS

European Search Report dated Mar. 10, 2020 corresponding to application No. EP19425071.

(Continued)

*Primary Examiner* — Samir Abdosh
(74) *Attorney, Agent, or Firm* — Nath, Goldberg & Meyer; Jerald L. Meyer

(57) ABSTRACT

A bulletproof protection elementary component of the tile type comprises a prism-shaped body having a first face and a second face of greater extension, which are opposite each other, and a side surface having a first height, at least one raised section from the first face by a second height, wherein the raised section is prism-shaped and has a base area which is less than an area of the first face. A ballistic panel and a bulletproof protection structure and a bulletproof vest, comprising a plurality of the elementary components, are also herein described.

12 Claims, 9 Drawing Sheets

(56) References Cited

U.S. PATENT DOCUMENTS

| | | | | |
|---|---|---|---|---|
| 9,612,091 | B1 * | 4/2017 | Blair | F41H 5/0492 |
| 10,562,269 | B2 * | 2/2020 | Hynes | C04B 35/76 |
| 10,794,665 | B1 * | 10/2020 | Taylor | B32B 5/18 |
| 2010/0005955 | A1 * | 1/2010 | Ohnstad | F41H 5/0421 89/36.02 |
| 2013/0160639 | A1 * | 6/2013 | Lee | F41H 5/0442 264/603 |
| 2016/0131457 | A1 * | 5/2016 | Bain | F41H 5/0492 89/36.02 |
| 2020/0033097 | A1 * | 1/2020 | Speyer | B32B 3/04 |

OTHER PUBLICATIONS

Italian Search Report dated Jun. 18, 2020 corresponding to application No. 93977.

* cited by examiner

FIG. 2B - PRIOR ART

BULLETPROOF PROTECTION ELEMENTARY COMPONENT

This is a Continuation Application of U.S. patent application Ser. No. 17/062,894, filed Oct. 5, 2020, an application claiming the benefit from European Application No. 19425071.8, filed Oct. 7, 2019, and from Italian Application No. 102019000018038, filed Oct. 7, 2019, the contents of each of which are hereby incorporated by reference in their entirety.

BACKGROUND

Technical Field

The present disclosure relates to a bulletproof protection elementary component.

The disclosure relates, particularly, but not exclusively, to a protection structure adapted to realize bulletproof vests capable of ensuring high protection levels, in particular greater than IIIa level according to the US NIJ regulation, and the following description is made with reference to this application field with the only purpose of simplifying the exposition.

Description of the Related Art

It is known to obtain effective bulletproof protections thanks to structures made by suitable combinations of interwoven fibers which are capable of absorbing and dispersing the bullet arresting and penetration force through the permanent deformation (elongation) of the fibers themselves.

The number of the overlapping layers determines the protection ability of the structure as a whole, classified in protection classes NIJ (United States) or SK (Germany), for instance.

These structures are generally made of high tenacity fibers, such as for instance the aramid fibers, which have a high mechanical tensile strength and high heat and flame resistance, which make them particularly suitable for use in bulletproof vests, the high resistance being in this case used to absorb the kinetic energy of the bullets through permanent deformation, thus minimizing the effects on the user wearing the vest.

Usually the fiber structures can provide effective protection against short-weapon bullets and limited to automatic weapons up to 7.65 caliber or 9 Parabellum, corresponding to 357 and 44 Magnum pistols and at speeds up to about 500 m/s. This corresponds to Ma protection level according to the US NIJ regulation.

To protect against greater caliber bullets, it is known to add at least one semi-rigid or rigid ballistic panel to these fiber structures, which panel can fragment the fastest bullets (over 700 m/s) into smaller parts which are more easily arrestable by the underlying fiber structure, thanks to the reduction of their energy (divided into the different fragmented parts).

In particular, these ballistic panels may be made of metal materials or more often of the so-called ballistic ceramic, namely a high strength alumina oxide that may precisely fragment the bullets, so as to divide them into splinters and usually have fairly large thicknesses, for instance between 5 and 12 mm, preferably between 7 and 10 mm.

A bulletproof protection structure for calibers greater than 357 and 44 Magnum, namely greater than Ma level of the US NIJ regulation, made according to the prior art is schematically illustrated in FIG. 1, globally indicated with reference number 10. A bulletproof protection structure 10 may be for instance used for shoring vehicles and tanks.

The bulletproof protection structure 10, in the case illustrated just by way of example, has a substantially rectangular shape and comprises a fiber base 11, made for instance of high-tenacity fibers, for instance interwoven, also referred to as ballistic fabric.

The bulletproof protection structure 10 further comprises a plurality of ballistic panels 12, associated with the fiber base 11, for instance by gluing. In particular, the ballistic panels 12 may be made of ballistic ceramic.

As illustrated in the figure, the ballistic panels 12 may be suitably spaced apart so as to define, between two contiguous panels, at least one portion 13 of the fiber base 11 free from the ballistic panels and thus allow folding the bulletproof protection structure 10 at folding lines indicated with reference number 14.

The bulletproof protection structure 10 illustrated in FIG. 1 can thus cover a prismatic-shaped object, in particular with a squared base since the ballistic panels 12 illustrated in the figure are of equal size.

Obviously it is possible to make the bulletproof protection structure 10 with ballistic panels 12 of different size, in particular suitable for following the shapes of the objects to be covered and protected, as evenly as possible. This makes the protection of non-regular surfaces complicated and practically impossible in case of rounded shapes, such as for instance cylindrical towers, actually imposing squared and sharp shapes. Moreover, the portions 13 without ballistic panels 12 are less protected, in particular penetrable by bullets of caliber greater than 357 and 44 Magnum or greater than Ma level of the US NIJ regulation. In these portions 13, which may also have great dimensions, the bulletproof protection is indeed only ensured by the fiber base 11.

This problem is even more significant in case of personal protections, wearable by a user, such as a garment or bulletproof vest, in particular suitable for an effective bulletproof protection for calibers greater than 357 and 44 Magnum, namely greater than Ma level of the US NIJ regulation.

As it is well known, the bulletproof vest is a garment, generally a vest-or-jacket-style garment, used by armies and law enforcement, which is useful to protect a wearer from gunshots or splinters from explosive fragmentation (in this case, being more commonly indicated as "flak jacket"), since it stops the bullet or splinters therein. This kind of garment is also used by security guards, for instance in service at the banks, or for the transport of valuables.

Generally, a bulletproof vest is made of an outer container suitably of ballistic fabric, and of one or more internal ballistic panels, for instance of ballistic ceramic.

These ballistic panels are particularly used as shields and thus are usually placed in front of the person's chest, thorax and in the rear part of the back and, in some cases, in the lower part, on the waistband of the lateral sides, on the right and on the left, so as to ensure protection to the vital organs of the user wearing the vest.

Of course, these ballistic panels are an obstacle to the dynamics of a moving human body, limiting the freedom of the bulletproof vest wearer. The user wearing the bulletproof vest is hindered for instance in the bust movements, or even in the side movements, forward and backward, the use of the reinforcing ballistic panels introducing in the garments an extreme stiffness and an additional weight that limit the comfort of the wearer, besides ensuring effective protection just to a surface that is substantially limited to the areas of vital organs, such as for instance the heart, thanks at least to one ballistic panel placed at the chest of the user wearing the vest.

To overcome the above indicated drawbacks, a bulletproof protection structure was proposed, which is made by means of a ballistic panel finely divided into a plurality of contiguous elements that are structurally independent and associated with a fabric portion, having a flexibility degree enough to ensure an extended coverage even of non-regular surfaces, like in the case of a bulletproof vest to be worn, meanwhile increasing the protection level. Such a bulletproof protection structure is described for instance in Italian patent application No. IT 102015000019024 filed on 28 May 2015 to the same applicant and schematically illustrated in FIG. 2A.

The bulletproof protection structure 20 comprises a fabric portion, particularly made by high-tenacity fibers, for instance interwoven, namely of ballistic fabric. The portion of ballistic fabric is substantially a flexible base 21 of the bulletproof protection structure 20. Alternatively, the ballistic fabric may comprise high molecular weight polyethylene.

In order to ensure a bulletproof protection for per calibers greater than 357 and 44 Magnum, namely higher than Ma level of the US NU regulation, the bulletproof protection structure 20 is further provided with a ballistic panel 22, associated with the flexible base 21, for instance by gluing or by providing a containing liner and suitable pockets made therein. The ballistic panel 22 thus realizes a reinforcing structure of the flexible base 21 made of ballistic fabric of the bulletproof protection structure 20.

The ballistic panel 22 is in particular finely divided into a plurality of elementary components 23 having a surface extension that is less than that of the ballistic panel 22 and being in a number sufficient to realize a coverage of an area to be protected AP by means of the ballistic panel 22.

These elementary components 23 are structurally independent and singularly associated with the flexible base 21 of ballistic fabric, so as to be contiguous and to minimize, at the limit to cancel, the portions of the area to be protected AP that are left uncovered, namely without elementary components 23.

In particular, the elementary components 23 are substantially made like tiles, in the shape of a flattened prism, with two faces, a bottom face and a top face respectively, of greater extension, and a side portion that runs along the entire contour of the elementary component 23 and has a height Hz selected based on the protection degree required to the ballistic panel 22. More particularly, referring to FIG. 2B, these elementary components 23 are associated at one of the faces of greater extension, such as the bottom face Fb, for instance by gluing with thermoplastic films, whereas the sides 23*s* are substantially without retaining means to the adjacent elementary components. This allows a movement of the elementary components 23 in a plane Z that is orthogonal to the plane defined by the ballistic panel 22, in practice orthogonal to the sheet whereon the bulletproof protection structure 20 is illustrated.

It is possible to compare the elementary components 23 into which the ballistic panel 22 is finely divided with tiles; these elementary components 23, indeed, cover the area to be protected AP like normal building tiles would cover a floor or a wall. In the case of the bulletproof protection structure 20, this floor or wall is actually a flexible substrate, made by the flexible base 21 of ballistic fabric, and the elementary components 23 in the form of tiles can follow the possible deformations thereof, for instance in case one wishes to realize bulletproof coverings for non-regular surfaces.

In this way, the ballistic panel 22 finely divided into the elementary components 23 and associated with the flexible base 21 of ballistic fabric, and thus the bulletproof protection structure 20 thus formed, are flexible structures capable of covering surfaces or structures with irregular trend.

The elementary components 23 preferably have a hexagonal shape, so as to obtain a bulletproof protection structure 20 that can be easily folded at substantially vertical or horizontal folding lines, using the local reference of the figure (in which just a vertical folding line 24*a* is indicated) and according to substantially oblique folding lines, like line 24*c*, as indicated in FIG. 2A.

Though advantageous under various aspects and capable of realizing a bulletproof protection structure having enough flexibility to ensure an extended coverage also for non-regular surfaces, the known solution has the drawback of having an interference area between adjacent elementary components or tiles under folding conditions, precisely at a folding line.

In particular, as schematically illustrated in FIGS. 3A and 3B, it is possible to verify that an interference zone Zi exists, which extends around to each folding line, for instance at the vertical folding line 25*a* indicated in FIG. 3A still with reference to a bulletproof protection structure 20 comprising a ballistic panel 22 that is finely divided into the elementary components 23 and associated with the flexible base 21 of ballistic fabric, the elementary components 23 being in particular glued to the flexible base 21 of ballistic fabric at the bottom face Fb thereof, as indicated in FIG. 3B.

It should be pointed out that the bottom face Fb of each elementary component 23 thus completely rests on and is linked to the ballistic fabric that forms the flexible base 21 of the bulletproof protection structure 20.

As shown in FIG. 3A, being the elementary components 23 hexagonal-shaped, the "real" fold line 24*a* has a broken or polygonal line trend that follows the edges of the single components or tiles based on an "ideal" fold line 25*a* which should follow the underlying fibers of ballistic fabric forming the flexible base, the "ideal" fold line 25*a* being rectilinear. Though in the figure the interference zone Zi is illustrated for a vertical "real" fold line 24*a*, a quite similar situation also occurs for a transverse fold line 24*c*, which still has a broken or polygonal line trend that follows the edges of the single components or tiles based on a rectilinear "ideal" fold line 25*c*.

The interference zone Zi substantially comprises portions of the top face Fa of the elementary components on the fold line 25*a*; in particular, in the interference zone Zi, each elementary component comes into conflict with an adjacent component along the "ideal" fold line 25*a*, thus preventing a correct fold of the bulletproof protection structure 20 comprising the ballistic panel 22 formed by the elementary components 23 and thus its precise adaptation to an irregularly shaped surface to be protected.

It is possible to verify that, by using hexagonal elementary components 23 having a transverse diameter or pitch Pt equal to 32 mm, with "pitch" meaning herein and in the following a distance between two parallel opposite faces of the hexagonal section of the elementary components 23, the interference zone Zi has a transverse dimension Hz equal to 9.2 mm.

The problem linked to elementary components 23 interfering around to the fold lines is also present in the case of non-hexagonal shaped elementary components 23, such as circular-shaped components, as illustrated in FIGS. 4A and 4B.

In this case, a real fold line 24 has a sinusoidal trend around to a rectilinear ideal fold line 25, defining, as previously, an interference zone Zi between adjacent elementary components 23 along the fold lines, as indicated in FIG. 4A still with reference to a bulletproof protection structure 20 comprising a ballistic panel 22 divided into the elementary components 23 having circular cross section with diameter D and associated with the flexible base 21 of ballistic fabric, the elementary components 23 being still glued to the flexible base 21 at the bottom face Fb thereof, as indicated in FIG. 4B, and the top face Fa thereof may also be dome-shaped, as illustrated in the figure.

In this way as well, it is possible to verify that, by using circular elementary components 23 having diameter Dt equal to 30 mm, the interference zone Zi has a transverse dimension Hz equal to 4 mm.

Essentially, the bulletproof protection structures 20, comprising a ballistic panel 22 divided into the elementary components 23, singularly glued to a flexible base 21 of ballistic fabric have a limited flexibility degree linked to the elongation properties of the fiber used to make the flexible base and to the type of adhesive used to link the elementary components 23 thereto.

Being well known that the high tenacity fibers used to realize such bulletproof protection structures 20 generally have an elongation equal to 3-4%, which is analogous to the elongation values provided by the adhesive films traditionally used in this field, we can immediately conclude that the structures thus obtained cannot be adapted to particularly irregular shapes, such as those of a human body, and therefore are not suitable for making bulletproof vests.

SUMMARY OF THE DISCLOSURE

Embodiments of the disclosure aim to provide a bulletproof protection structure having a sufficient flexibility degree to also ensure an extended coverage for non-regular surfaces, like in the case of a bulletproof vest to be worn, meanwhile minimizing the exposed ballistic fabric surfaces, thus increasing the protection level conferred by the vest, so as to overcome the limitations and drawbacks which nowadays still affect the structures and vests realized according to the prior art.

According to an embodiment of the present disclosure a bulletproof protection structure is made by means of a plurality of contiguous and independent elementary components which are shaped so as to have at least one raised section adapted to delimit the connection surface, in particular by gluing, between the elementary components and a flexible base of ballistic fabric of the protection structure, thus eliminating interferences between contiguous elementary components on occasion of a folding of the structure itself.

The bulletproof protection elementary component of the tile type comprises a prism-shaped body with a first face and a second face of greater extension, which are opposite each other, and a side surface having a first height, comprising at least one raised section from the first face by a second height, the raised section being prism-shaped and having a base area which is less than an area of the first face.

More particularly, the disclosure comprises the following additional and optional features, taken singularly or in combination if necessary.

According to another aspect of the disclosure, the bulletproof protection elementary component of the tile type may comprise a free surface defined in the first face as a remaining area around to the raised section.

According to another aspect of the disclosure, the raised section may be concentric with the first face of the body.

Furthermore, according to another aspect of the disclosure, the second height of the raised section may have values comprised between 0.5 mm and 2 mm, preferably 1 mm.

Alternatively, the second height of the raised section may have values greater than 2 mm.

According to a further aspect of the disclosure, the first height of the body may have values comprised between 2 mm and 15 mm, preferably 10 mm.

Still according to another aspect of the disclosure, the body may comprise a recess realized in the second face and extending in the body by a third height.

In particular, the recess may have shape and dimensions equal or comparable to the raised section and be realized concentrically thereto, with "comparable" meaning values that are equal to each other or differ from each other by ±10%.

According to another aspect of the disclosure, the body may have a hexagonal base and the raised section may have a circular base.

In particular, the hexagonal base of the body may have a transverse diameter or pitch with values comprised between 22 mm and 44 mm, preferably equal to 32 mm and the circular base of the raised section may have a diameter with values comprised between 17 mm and 39 mm, preferably equal to 27 mm.

Alternatively, the body may have a hexagonal base and the raised section may have a polygonal base.

According to another aspect of the disclosure, the bulletproof protection elementary component of the tile type may be made of a bulletproof material selected from a sintered material, such as aluminum oxide or a carbide, such as silicon carbide or boron silicon.

According to a further aspect of the disclosure, the raised section may be made integral with the body.

Furthermore, the body, the raised section and the recess may be prism-shaped with a base having a shape selected from circular, oval, squared, rectangular, hexagonal or polygonal and in case also with a concave shape, such as a star shape.

The problem is also solved by a bulletproof protection ballistic panel finely divided into a plurality di elementary components realized as above indicated.

According to another aspect of the disclosure, the elementary components of the ballistic panel may be contiguous and independent with each other and define a plurality of free areas in the ballistic panel, each free area comprising free surfaces of a plurality of elementary components.

The ballistic panel may also comprise a plurality of preferential folding lines, arranged in the free areas.

Furthermore, the problem is solved by a bulletproof protection structure comprising at least one flexible base and one reinforcing structure realized by means of at least one ballistic panel associated with the flexible base, the ballistic panel being finely divided into a plurality di elementary components which are singularly associated with the flexible base, structurally independent with each other and not linked to each other, each of the elementary components being realized as above indicated.

According to another aspect of the disclosure, the elementary components of the bulletproof protection structure may be associated with the flexible base only at the raised section.

In particular, the bulletproof protection structure may also comprise connection means adapted to associate the elementary components with the flexible base.

According to another aspect of the disclosure, the connection means may comprise a plurality of adhesive layers, each one covering a raised section of an elementary component.

In particular, the adhesive layers may comprise thermoplastic films.

According to a further aspect of the disclosure, the flexible base of the bulletproof protection structure may be made of ballistic fabric, comprising in turn fibers selected from high tenacity fibers and high molecular weight polyethylene.

The bulletproof protection structure may comprise in particular a plurality of preferential folding lines, arranged in a plurality of free areas formed by free surfaces of consecutive elementary components, in the free areas the elementary components not being linked to the flexible base, the structure being adapted to cover surfaces or structures with irregular trend by folding according to the folding lines.

Finally, the problem is solved by a bulletproof vest comprising a flexible base and a reinforcing structure realized by means of a ballistic panel associated with the flexible base which form a bulletproof protection structure as above indicated.

According to another aspect of the disclosure, the ballistic panel formed by the plurality of elementary components covers an area to be protected substantially corresponding to the entire extension of the bulletproof vest, so as to form a total shield for a user wearing it, the ballistic panel being foldable at the folding lines housed in the free areas made of free surfaces of adjacent elementary components.

The bulletproof vest may also comprise a containing liner provided with appropriate pockets and external hooks, to possibly house the ballistic panel.

The characteristics and advantages of the elementary component, the ballistic panel, the bulletproof protection structure and the bulletproof vest according to the disclosure will be apparent from the description, made hereinafter, of embodiments thereof, given by indicative and non-limiting examples, with reference to the accompanying drawings.

BRIEF DESCRIPTION OF THE DRAWINGS

FIGS. 2A and 2B schematically show a bulletproof protection structure made according to the prior art, in a frontal view thereof and in an enlargement of a detail, respectively;

DETAILED DESCRIPTION

Figure 1:
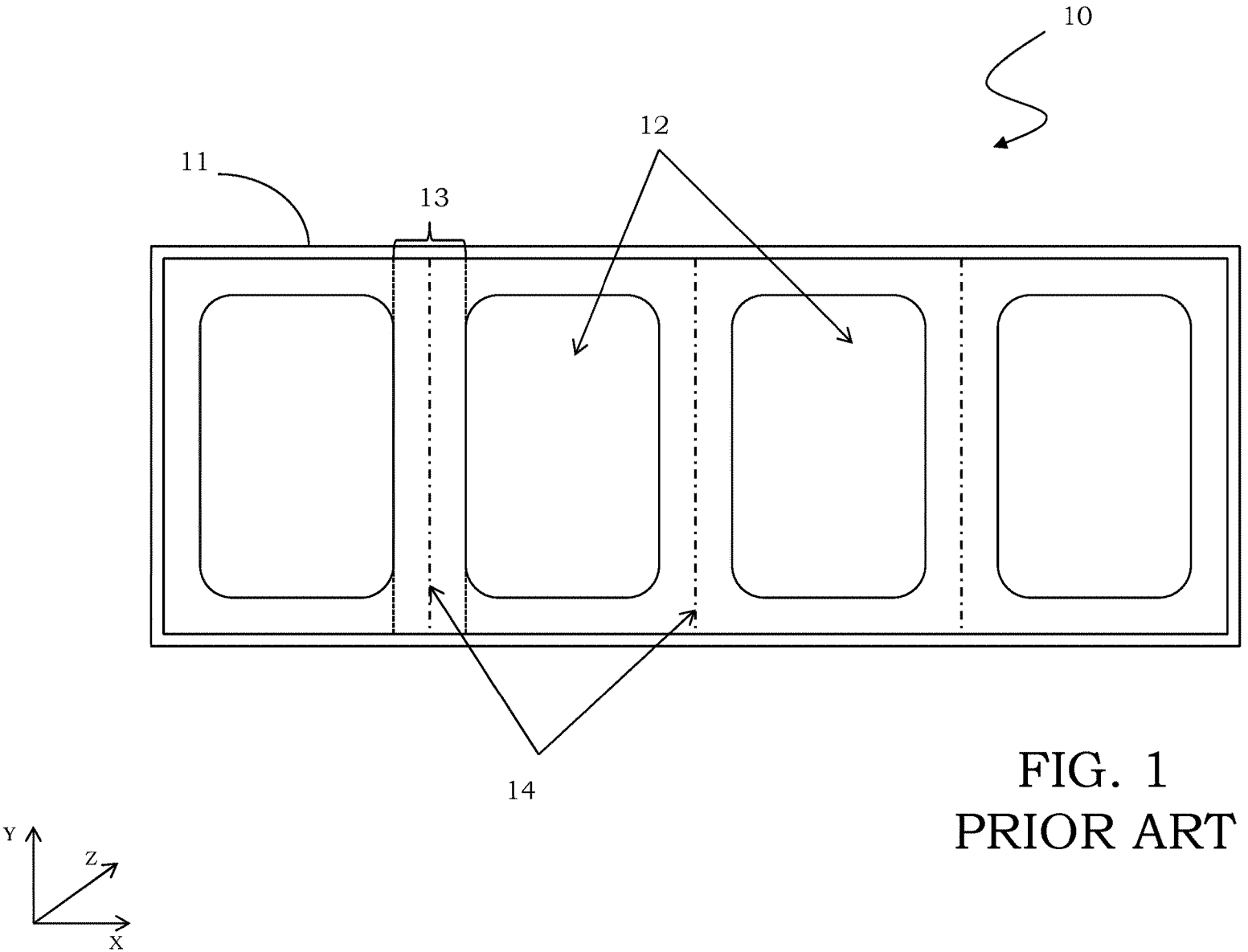
FIG. 1 PRIOR ART
FIG. 1 schematically shows a bulletproof protection structure made according to the prior art.
Figure 2A:
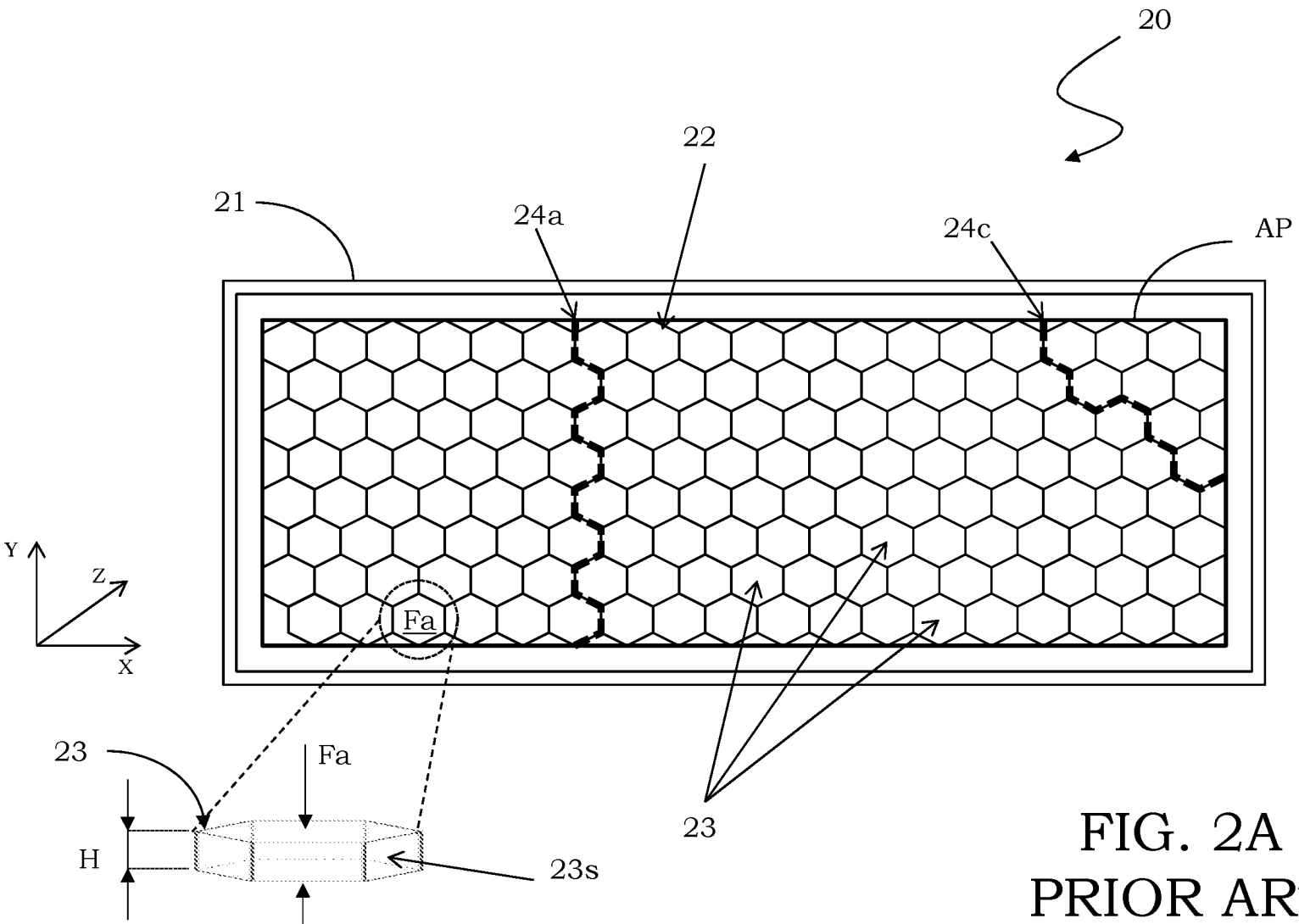
FIG. 2A PRIOR ART
Figure 3B:
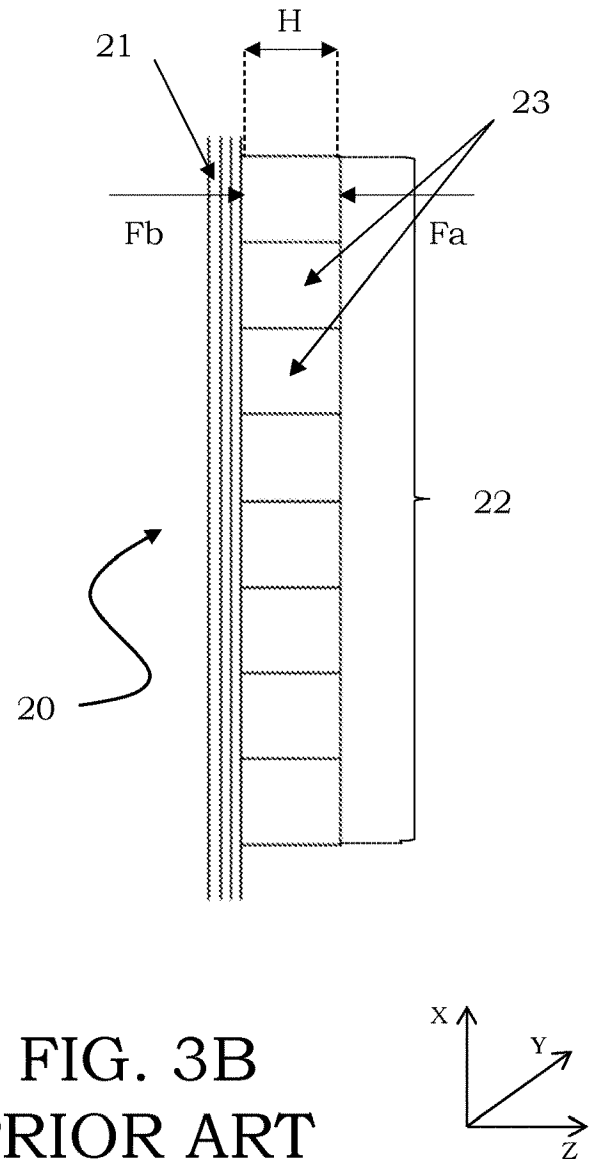
FIG. 3B PRIOR ART
FIGS. 3A and 3B schematically show a portion of the bulletproof protection structure of FIG. 2, in respective frontal and side views.
Figure 3A:
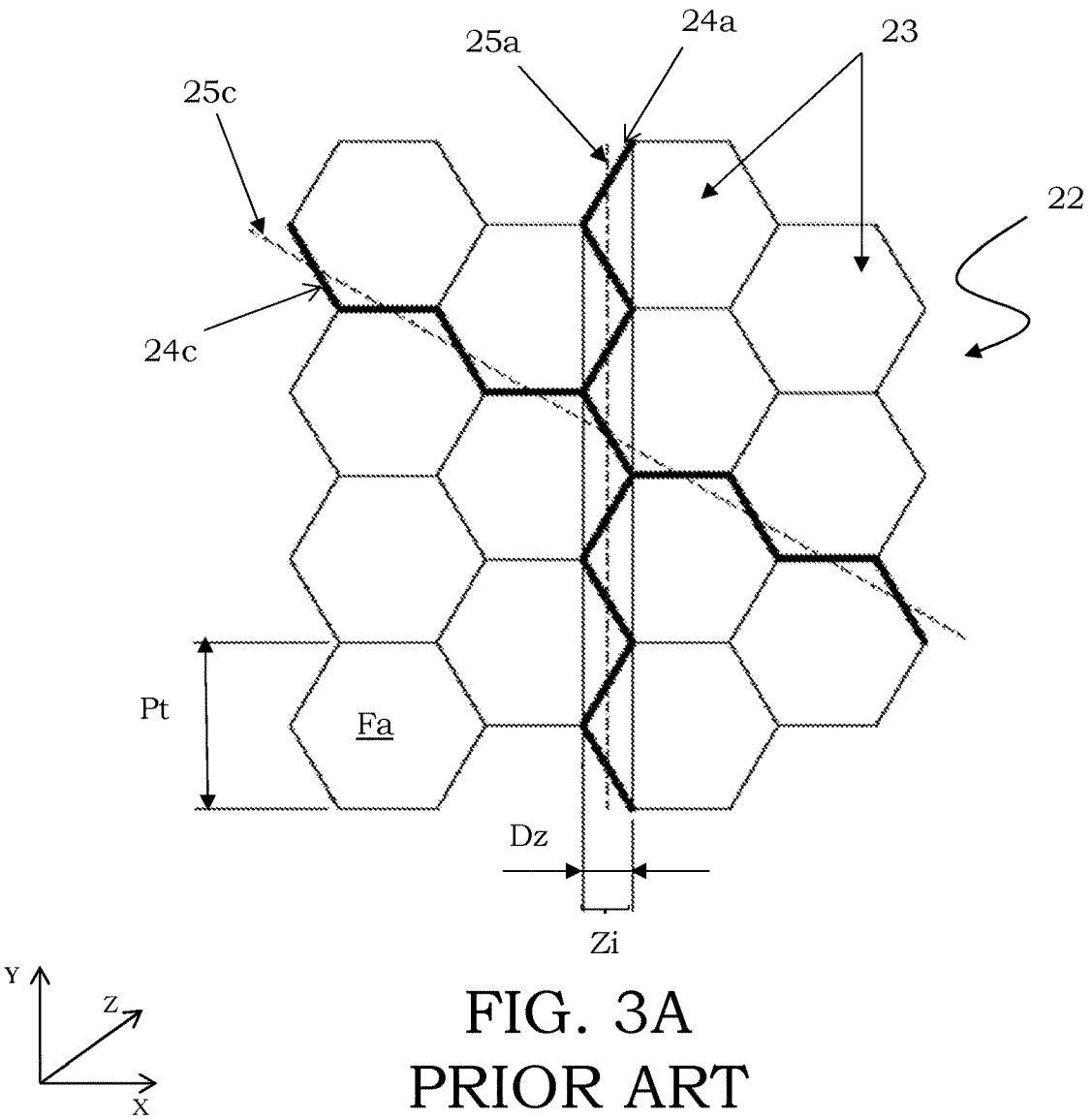
FIG. 3A PRIOR ART
Figure 4B:
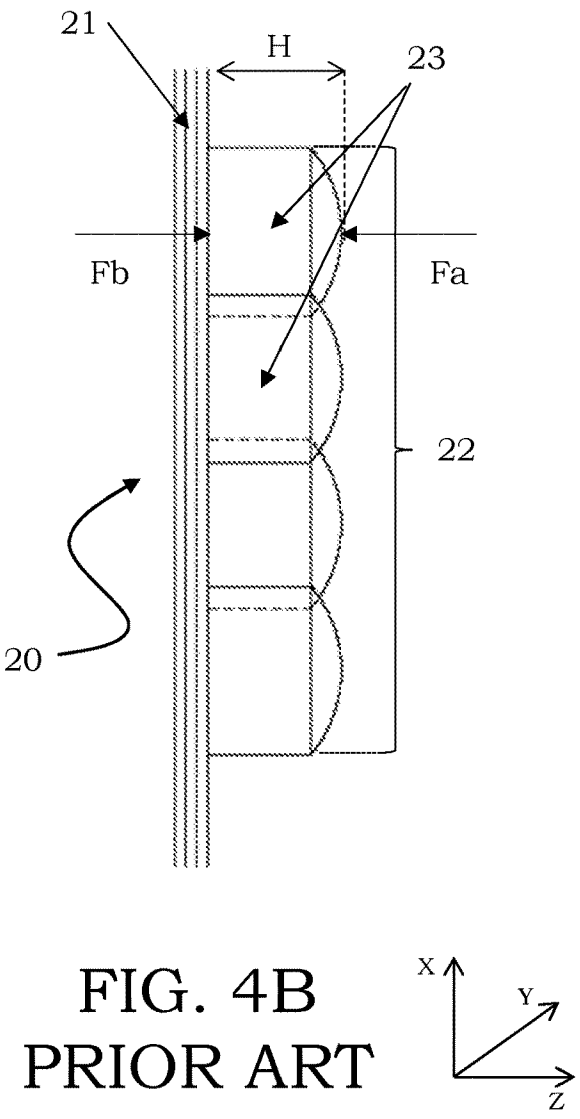
FIG. 4B PRIOR ART
FIGS. 4A and 4B schematically show a portion of the bulletproof protection structure according to a known alternative embodiment, in respective frontal and side views.
Figure 4A:
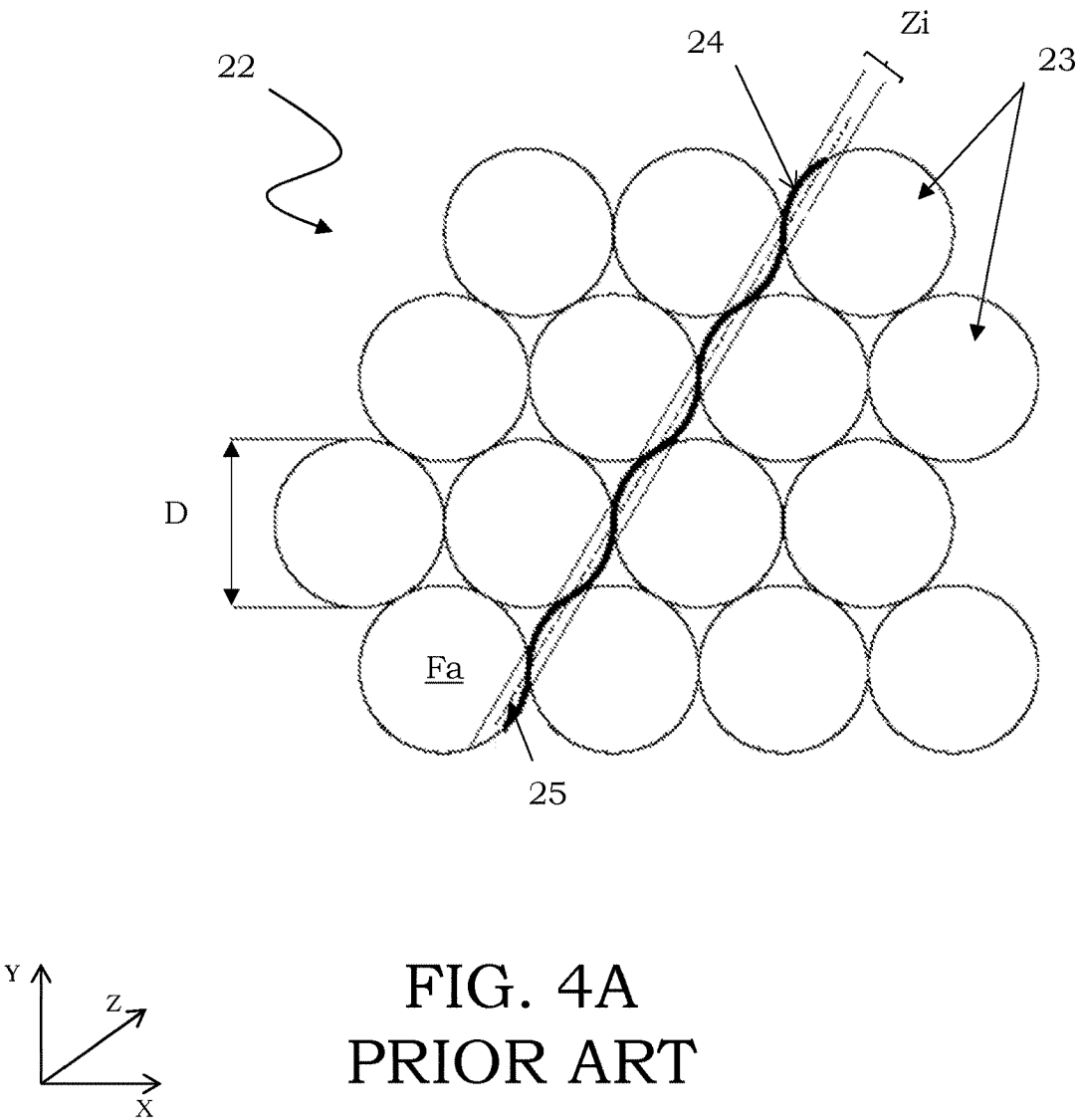
FIG. 4A PRIOR ART
Figure 5A:
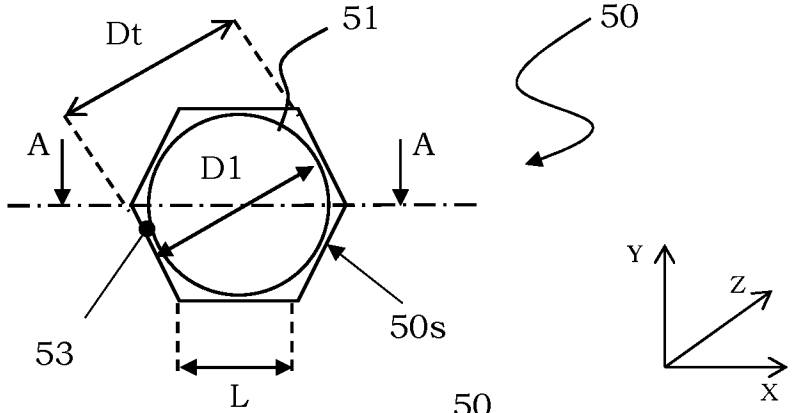
FIGS. 5A-5C schematically show a bulletproof protection elementary component made according to the present disclosure, in respective top, side and axonometric views.
Figure 5B:
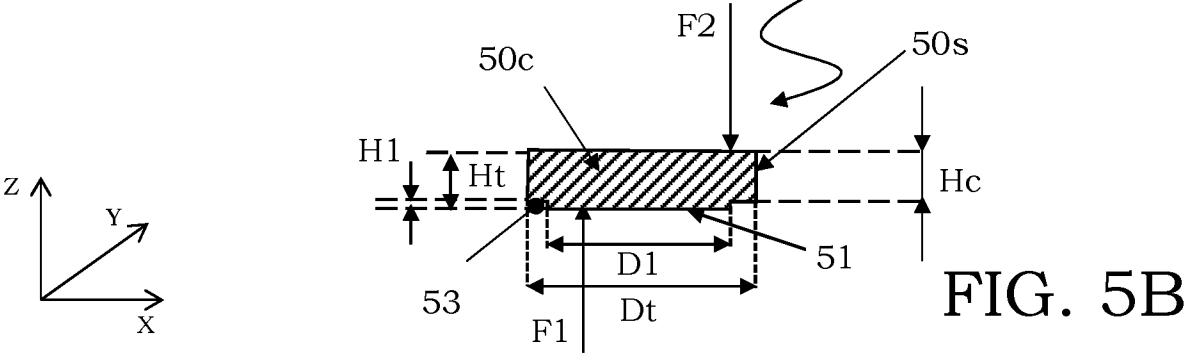
Figure 5C:
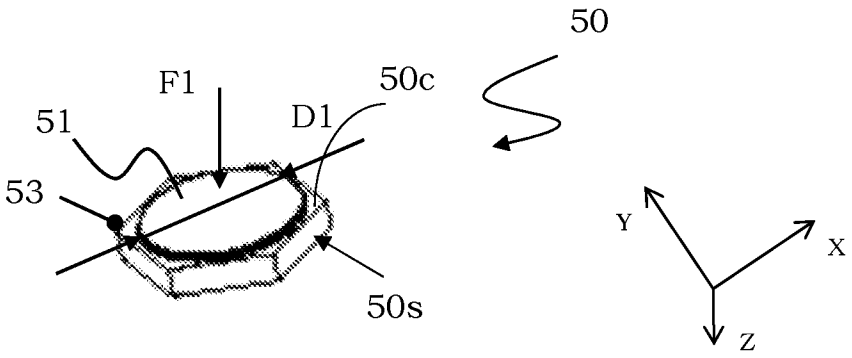
Figure 6A:
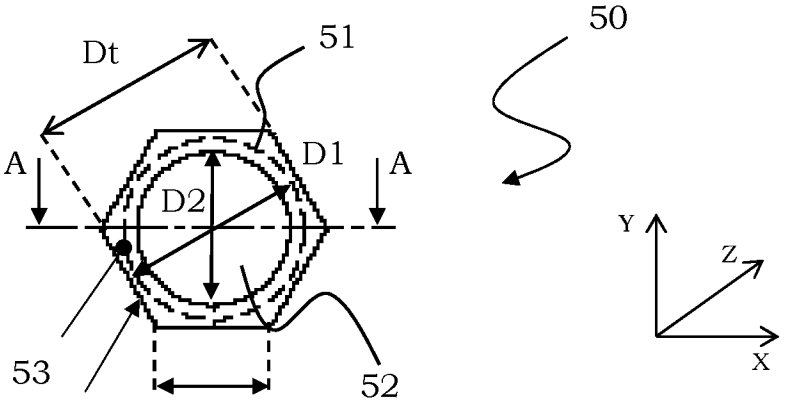
FIGS. 6A-6D schematically show un bulletproof protection elementary component made according to an alternative embodiment of the present disclosure, in respective top, side and axonometric views.
Figure 6B:
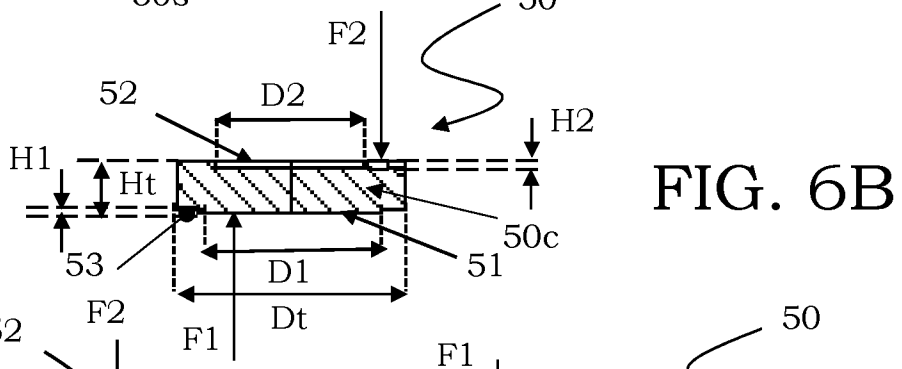
Figure 6D:
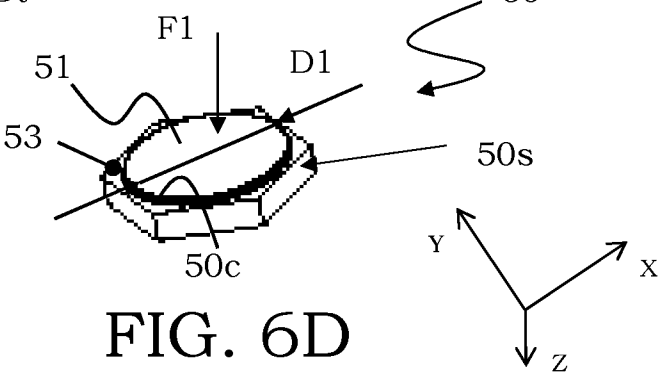
Figure 6C:
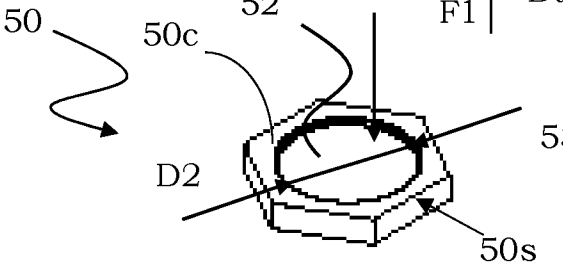

With reference to these figures and in particular to FIGS. 5A-5C, an elementary component 50 is described, which is adapted to make a bulletproof protection structure comprising a ballistic panel formed by a plurality of the components, which are independent and contiguous, associated with a flexible base of ballistic fabric.

It should be noted that the figures represent schematic views and are not drawn to scale, but instead they are drawn so as to emphasize the important features of the disclosure. Furthermore, in the figures, the different elements are depicted in a schematic manner, their shape varying depending on the desired application. Furthermore, particular features described in relation to an embodiment may also be used in other embodiments, in any combination.

In the preferred embodiment illustrated in FIGS. 5A-5C, the elementary component 50 is prism-shaped with cross-section or hexagonal base, having side L and transverse diameter or pitch Dt, which is meant as the distance between two opposite faces that are parallel in the hexagonal section.

In a particularly preferred embodiment, the hexagonal elementary component 50 has side L of length comprises between 10 mm and 50 mm, preferably equal to 20 mm or to 30 mm, usually indicated as having key dimension 20 or key 30, respectively.

The elementary component 50 has a flattened prism shape with two faces of greater extension, in particular a first face F1 or bottom face and a second face F2 or top face, as well as a side surface 50*s*, the body 50*c* having height Hc. Essentially, the elementary component 50 has a shape similar to a tile.

Suitably according to the present disclosure, the elementary component 50 of the tile type or tile-shaped elementary component 50 comprises a raised section 51 from the first face F1 of the body 50*c*. The first face F1 is intended in particular to be associated with a flexible base, for instance of ballistic fabric, to realize a bulletproof protection structure, as will be explained hereinafter.

Preferably, the raised section 51 is made integral with the body 50*c* of the tile-shaped elementary component 50.

More particularly, the raised section 51 has a prism shape with cross-section or circular base of diameter D1 adapted to be inscribed in the hexagonal cross section of the body 50*c*, and thus in the first face F1, and is made so as to protrude by a height H1 with respect to the body 50*c*, thus leaving a free surface 53 on the first face F1. In other words, the raised section 51 has a base area that is less than an area of the first face F1 and the free surface 53 is defined in the first face F1 as a remaining area around to the raised section 51, preferably made so as to be concentric to the first face F1. The raised section 51 may also have a prism shape with cross section or polygonal base.

The sum of the heights Hc and H1 of the body 50*c* and of the raised section 51, respectively, is equal to the total height Ht of the tile-shaped elementary component 50, namely its overall dimensions according to a plane z that is orthogonal to the first and second faces F1 and F2, as indicated in the local reference of the figures.

In particular, the height H1 of the raised section 51 has values typically comprised between 0.5 mm and 2 mm, preferably 1 mm and the height Hc of the body 50*c* has values comprised between 2 mm and 15 mm, preferably 10 mm. The height H1 of the raised section 51 may have values greater than 2 mm in dedicated cases.

It is obviously possible to realize the tile-shaped elementary components 50 and the related raised sections 51 by means of prisms with differently shaped sections or bases with respect to those illustrated in FIGS. 5A-5C, with the only constraint that the raised section 51 has a section with dimensions such that it can be contained in the body section 50*c*, namely in the first face F1 of the tile-shaped elementary component 50, leaving at least one exposed portion so as to realize a free surface 53.

For instance, in case of a hexagonal tile-shaped elementary component 50 having a transverse diameter or pitch Dt equal to 32 mm, it is possible to use a raised section 51 with circular section of diameter D1 equal to 27 mm. In general, the hexagonal base of the body 50*c* has a transverse diameter or pitch Dt with values comprised between 22 mm and 44 mm and the circular base of the raised section 51 has a diameter D1 with values comprised between 17 mm and 39 mm Indeed, in this way, as it will be explained hereinafter, when a plurality of elementary components 50 may be arranged contiguously to each other to cover a certain area to be protected, the diameter D1 is less than the tangency of the hexagon sections of adjacent tile-shaped elementary components 50.

Suitably, it is possible to choose among circular, oval, squared, rectangular, hexagonal or anyway polygonal sections or bases, in the case even with concave shapes like a star section.

In any case, as it will be better clarified hereinafter, the raised section 51 is adapted to realize a connection delimited portion with a ballistic fabric, for instance with a flexible base of a bulletproof protection structure, so that the free surface 53 is not linked to the base.

The tile-shaped elementary components 50 and the raised sections 51 are preferably made of a sintered material, such as aluminum oxide (ballistic ceramic) or carbides, such as silicon or boron carbides, materials which are usually used in the bulletproof protection of vehicles and/or people.

According to an alternative embodiment schematically illustrated in FIGS. 6A-6D, the tile-shaped elementary component 50 also comprises a recess 52, suitably realized in the body 50*c* at the second face F2, opposite the first face F1 from which the raised section 51 protrudes.

In the preferred embodiment illustrated in FIGS. 6A-6D, the tile-shaped elementary component 50 has a hexagonal cross section or base and the raised section 51 and the recess 52 have circular transversal sections or bases.

In particular, the recess 52 is made with shapes and dimensions equal to the raised section 51 and concentrically thereto along axis z; more particularly, the recess 52 has a diameter D2 of equal dimensions which are comparable to those of the diameter D1 of the raised section 51, with comparable meaning that the diameters D1 and D2 are equal to each other or differ from each other by ±10%. Furthermore, the recess 52 has a height H2, with respect to the second face F2, that is equal or comparable to the height H1 of the raised section 51 with respect to the first face F1.

Essentially, the raised section 51 protrudes from the first face F1 of the body 50*c* by a height H1 that is substantially equal to the height H2 by which the recess 52 penetrates into the body 50*c* from the second face F2.

In this way, suitably according to this alternative embodiment, it is possible to obtain a tile-shaped elementary component 50 having a substantially constant thickness over the entire surface extension thereof, namely in the plane defined by the axes x and y of the local reference of the figures. It is thus immediate to verify that such a tile-shaped elementary component 50 having a constant thickness suitably has a constant ballistic resistance.

Figures 7, 7A:
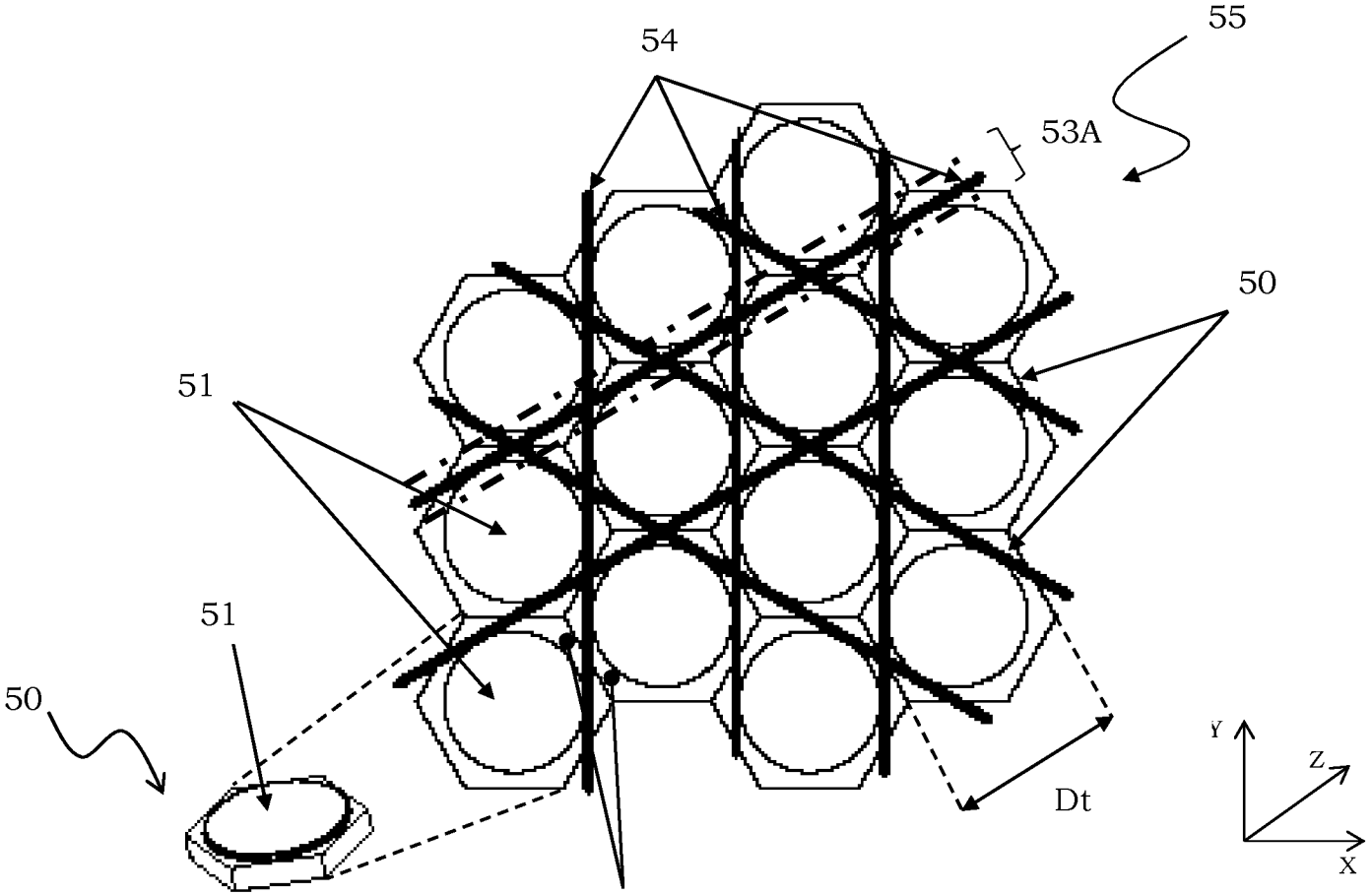
FIGS. 7 and 7A schematically show a ballistic panel made according to the present disclosure by using the elementary component of FIG. 5C, in a rear view thereof and in an enlargement of a detail, respectively.

By using a plurality of tile-shaped elementary components 50 of the type illustrated in FIG. 5A-5D or 6A-6C, it is possible to realize a ballistic panel 55 according to the present disclosure, schematically illustrated in FIG. 7. In particular, the ballistic panel 55 is finely divided into the plurality of tile-shaped elementary components 50, indicated in FIG. 7A, each one having a surface extension at the first and second faces F1 and F2 thereof which is less than that of the ballistic panel 55 as a whole.

More particularly, each tile-shaped elementary component 50 comprises faces F1 and F2 having a surface extension equal to less than 20% of the surface extension of the ballistic panel 55.

Suitably, the tile-shaped elementary components 50 of the ballistic panel 55 are contiguous and independent, a number of tile-shaped elementary components 50 being provided so as to be enough to realize a coverage of an area that should be protected.

As previously explained, each tile-shaped elementary component 50 has a raised section 51 with dimensions suitable for being contained in the first face F1 of its body 50*c*, thus defining the free surface 53 on the first face F1.

Suitably, the free surface 53 of a plurality of consecutive tile-shaped elementary components 50 realizes a free area 53A of the ballistic panel 55 where it is possible to perform the folding thereof without the tile-shaped elementary components 50 interfering with each other. The ballistic panel 55 has thus a plurality of preferential folding lines 54, arranged in the free areas 53A, where the interference between the tile-shaped elementary components 50 is limited.

It is pointed out that, thanks to the combination of the plurality of tile-shaped elementary components 50 provided with raised sections 51 adapted to define a free surface 53 that substantially distributes along the entire periphery of the first face F1, the ballistic panel 55 comprises free areas 53A that substantially distribute in all directions and thus allow providing respective folding lines in any direction.

Figure 8A:
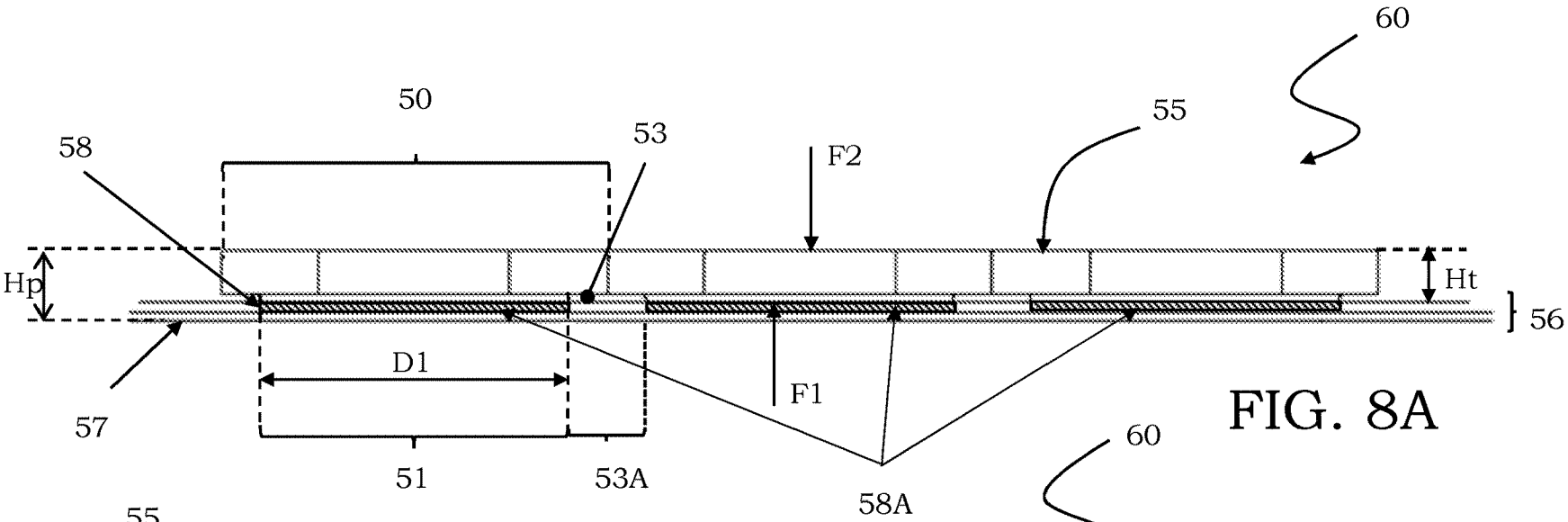
FIGS. 8A and 8B schematically show side views of a bulletproof protection structure comprising the ballistic panel of FIG. 7, in different application configurations thereof.

It is thus possible to realize a bulletproof protection structure 60 comprising a reinforcing structure made by means of at least one ballistic panel 55 associated with a flexible base 56, made for instance by a layer of ballistic fabric 57 and provided with suitable connection means 58 with the ballistic panel 55, as schematically illustrated in FIG. 8A.

More particularly, the layer of ballistic fabric 57 may be made of high tenacity fibers or of high molecular weight polyethylene, suitably associated with a ballistic panel 55 comprising a plurality of tile-shaped elementary components 50 made of a sintered material, such as aluminum oxide (ballistic ceramic) or carbides, such as silicon or boron carbides, the ballistic panel 55 realizing a reinforcing structure of the flexible base 56 of the bulletproof protection structure 60.

The bulletproof protection structure 60 thus realized is in particular of the type adapted to ensure an effective bulletproof protection for calibers greater than 357 and 44 Magnum, namely greater than IIIa level of the US NU regulation.

Such a bulletproof protection structure 60 has an overall height Hp given by the sum of the height Ht of the tile-shaped elementary components 50 forming the ballistic panel 55 and of the thickness of the flexible base 56 and has values comprised between 0.7 mm and 20 mm, preferably 12 mm.

It is possible to compare the tile-shaped elementary components 50 of the ballistic panel 55 to tiles that are distributed so as to uniformly cover an area to be protected AP like normal building tiles would cover a floor or a wall. In the case of the bulletproof protection structure 60, the floor or wall is actually a flexible base 56, realized by the layer of ballistic fabric 57, and the tile-shaped elementary components 50 are capable of following the possible deformations thereof, for instance in case one wishes to realize bulletproof coatings of non-regular surfaces.

Suitably according to the present disclosure, the tile-shaped elementary components 50 of the ballistic panel 55 are arranged with their first face F1 facing towards the flexible base 56; in this way, the connection between the tile-shaped elementary components 50 and the connection means 58 of the flexible base 56 is only realized at the respective raised sections 51. More particularly, in the preferred embodiment illustrated in FIG. 8A, the connection means 58 comprise a plurality of adhesive layers 58A, such as thermoplastic films, each covering a raised section 51 of a tile-shaped elementary component 50. It is obviously possible to use different connection means 58 such as mechanical connectors, screws or pins to integrally link the tile-shaped elementary components 50 to the flexible base 56, in particular to the layer of ballistic fabric 57.

It is important to point out that the particular conformation of the tile-shaped elementary components 50, in particular the presence of the raised section 51, advantageously allows limiting the extension of the connection means 58 with the flexible base 56, namely the surface of the adhesive layers 58A.

Figure 8B:
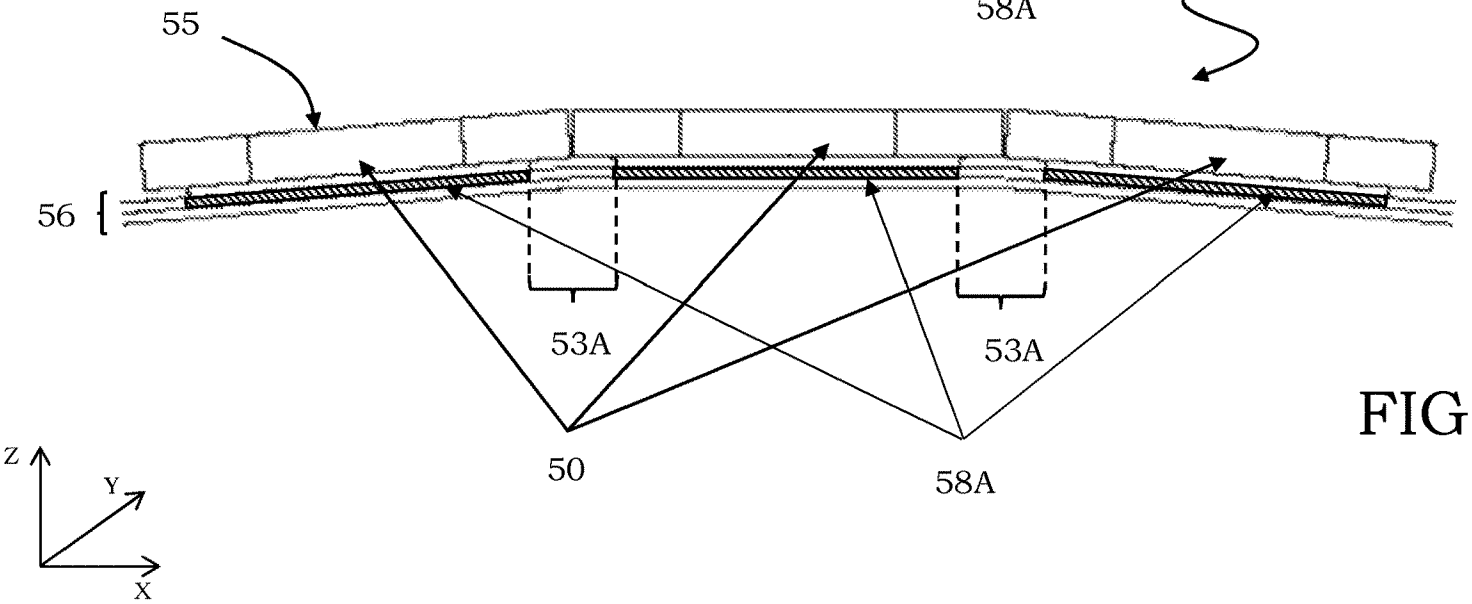

In this way, the fabric portions of the flexible base 56 corresponding to the free areas 53A defined by the free surfaces 53 of the adjacent tile-shaped elementary components 50, are thus free from adhesive and are free to move, as schematically illustrated in FIG. 8B, which shows the bulletproof protection structure 60 folded so as to adapt to a non-flat surface.

The bulletproof protection structure 60 thus obtained is indeed advantageously extremely flexible in all directions, since the ballistic panel 55 therein comprised can be folded at the folding lines 54 arranged in the free areas 53A. The ballistic panel 55 and the corresponding bulletproof protection structure 60 may thus be used to protect shapes with complex geometries, such as for instance the human body.

Figure 9:
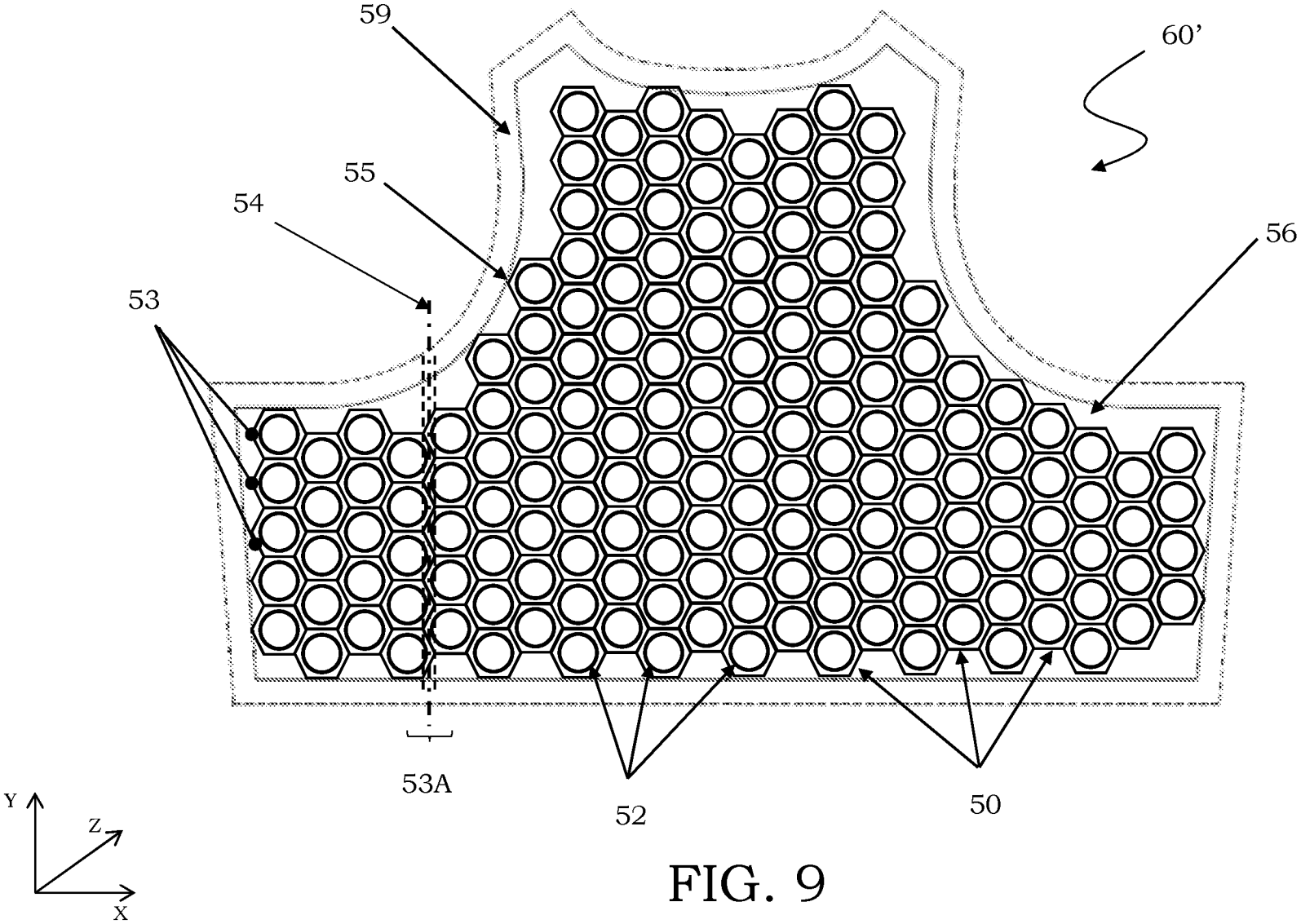
FIG. 9 schematically shows a frontal view of a bulletproof vest made according to the present disclosure.

In particular, the bulletproof protection structure 60 may take up the shape of a bulletproof vest 60', as schematically illustrated in FIG. 9.

In the example illustrated in FIG. 9, the bulletproof vest 60' comprises a ballistic panel 55 made by a plurality of hexagonal tile-shaped elementary components 50 and is suitable for ensuring a bulletproof protection for calibers greater than 357 and 44 Magnum, namely greater than IIIa level of the US NU regulation almost in the entire surface thereof, with a high versatility degree for the user wearing it. The bulletproof vest 60' is substantially in the shape of a vest. It is obviously possible to provide for a different shape, but equally wearable by a user.

In particular, the bulletproof vest 60' comprises a flexible base 56 of ballistic fabric, in particular made of high tenacity fibers, for instance interwoven, in the case inserted in a containing lining 59.

Suitably, the tile-shaped elementary components 50 of the ballistic panel 55 of the bulletproof vest 60' have respective raised sections 51 adapted to define free surfaces 53 on the first face F1 of each tile-shaped elementary component 50 and thus free areas 53A inside the ballistic panel 55, where it is possible to define folding lines 54 for the bulletproof vest 60' itself.

In this case, the ballistic panel 55 made by the tile-shaped elementary components 50 substantially extends to the entire extension of the bulletproof vest 60', so as to ensure a high degree bulletproof protection, in particular for calibers greater than 357 and 44 Magnum, namely greater than Ma level of the US NIJ regulation, almost total for the user wearing it.

As indicated in the figure, the ballistic panel 55 is thus realized so as to cover almost the whole chest, the lateral sides and also the back (not shown) of the user wearing the bulletproof vest 60', also following the shape of the axillary portions, chinstrap and shoulders. The ballistic panel 55 is actually a total shield for the user wearing the bulletproof vest 60' that can be folded without encountering resistance at the folding lines 54, being thus flexible and suitable for being worn in any circumstance and ensuring sufficient freedom of movement in any direction for the user wearing it.

It is pointed out that the presence of the connection means 58, in particular adhesive layers 58A, only at the raised sections 51 of the tile-shaped elementary components 50 allows the maximum freedom degree for the bulletproof vest 60' that comprises the flexible base 56 of ballistic fabric and the ballistic panel 55 realized by the tile-shaped elementary components 50, in particular, thus ensuring the correct covering of the user's body wearing it, meanwhile minimizing the impediments to movement.

The bulletproof vest 60' could also comprise a lower protection portion (not illustrated), in the form for instance of a strip still provided with reinforcing elementary components that can pass between the user's legs wearing it.

In conclusion, the innovative configuration of the elementary components according to the disclosure allows realizing a ballistic panel and a bulletproof protection structure comprising it which can ensure an effective bulletproof protection for calibers greater than 357 and 44 Magnum, namely greater than Ma level of the US NIJ regulation, in a finale structure that is flexible enough to also cover non-regular surfaces.

For instance, it is possible to imagine that a bulletproof protection structure of the illustrated type may cover the hood of a vehicle such as a Jeep®.

The bulletproof protection structure according to the present disclosure advantageously allows increasing the protection level until reaching calibers such as AK47 and SS109 NATO; furthermore, by increasing the thicknesses both of the portion of ballistic fabric and of the elementary components into which the ballistic panel is finely divided, it is possible to reach more important calibers, such as Dragunov or SVD rifle (acronym from the Russian: "Snayperskaya Vintovka Dragunova") M2AP NATO.

Furthermore, it is pointed out that the use of elementary components to form the ballistic panel of such a structure allows minimizing, at the limit eliminating, the portions of the area to be protected which are left uncovered, namely without reinforcing elementary components, though ensuring the flexibility and thus the possibility of folding the final structure thus obtained.

Furthermore, thanks to the use of a ballistic panel finely divided into a plurality of elementary components or tiles provided with raised sections that can suitably limit the extension of the connection with a flexible base, it is possible to realize a bulletproof protection structure, such as a bulletproof vest, which remains flexible, but ensures a bulletproof protection for calibers greater than 357 and 44 Magnum, namely greater than Ma level of the US NU regulation.

In particular, the presence of the raised sections provided in all of the elementary components forming the ballistic panel comprised in a bulletproof protection structure allows defining free areas in the ballistic panel where the adjacent elementary components do not interfere with each other and the ballistic fabric of the flexible base is not glued thereto; more particularly, the free areas extend in any direction, since corresponding folding lines of the ballistic panel may be defined therein.

Suitably, the bulletproof vest according to the present disclosure can protect more extended surfaces (in particular different parts of the body) with respect to the known solutions, maintaining the flexibility of the vest as a whole and thus a greater comfort for a wearer.

Indeed, the user wearing such a bulletproof vest is not hindered in his movements, despite the maximization of the area to be protected until it substantially corresponds to the entire extension of the vest itself.

Obviously, a person skilled in the art, in order to meet particular needs and specifications, may carry out several changes and modifications to the elementary components, the ballistic panel and the bulletproof protection structure, in particular in the shape of the bulletproof vest above described.

For instance, it is possible to provide for elementary components having a different shape from those illustrated, such as a circular or oval shape. The bulletproof vest could also have different shapes than the vest one illustrated and could comprise more ballistic panels, each divided into a plurality di elementary components in the case separated by portions of ballistic fabric.

From the foregoing it will be appreciated that, although specific embodiments of the disclosure have been described herein for purposes of illustration, various modifications may be made without deviating from the spirit and scope of the disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A bulletproof protection ballistic panel being finely divided into a plurality of elementary components, wherein each elementary component is a tile and comprises:

a prism-shaped body having a first face and a second face of greater extension, which are opposite each other, and a side surface having a first height, and at least one raised section raised from the first face by a second height, wherein the raised section is prism-shaped and has a base area which is less than an area of the first face, and wherein the elementary components are contiguous and independent with each other and define a plurality of free areas in the ballistic panel, each free area comprising free surfaces of a plurality of the elementary components, the ballistic panel comprising a plurality of preferential folding lines, arranged in the free areas.

2. The bulletproof protection ballistic panel of claim 1, wherein each elementary component further comprises a free surface surrounding the raised section.

3. The bulletproof protection ballistic panel of claim 2, wherein the raised section of each elementary component is concentric with the first face of the prism-shaped body.

4. The bulletproof protection ballistic panel of claim 1, wherein the prism-shaped body of each elementary component comprises at least one recess realized in the second face thereof, the at least one recess extending in the prism-shaped body by a third height.

5. The bulletproof protection ballistic panel of claim 4, wherein the recess of the prism-shaped body of each elementary component has shape and dimensions comparable to the raised section of each elementary and is realized concentrically thereto, with comparable meaning values that are equal to each other or that differ from each other by ±10%.

6. The bulletproof protection ballistic panel of claim 1, wherein the raised section of each elementary component is made integral with the corresponding prism-shaped body.

7. The bulletproof protection structure comprising at least one flexible base and one reinforcing structure realized by means of at least one ballistic panel associated with the flexible base, wherein the ballistic panel comprises a plurality of elementary components which are singularly associated with the flexible base, structurally independent with each other and not linked to each other, wherein each elementary component comprises:

a prism-shaped body having a first face and a second face of greater extension, which are opposite each other, and a side surface having a first height, and at least one raised section raised from the first face by a second height, wherein the raised section is prism-shaped and has a base area which is less than an area of the first face, and wherein the bulletproof protection structure comprises a plurality of preferential folding lines, arranged in a plurality of free areas formed by free surfaces between consecutive elementary components, and wherein the elementary components are being linked to the flexible base in the free areas, the bulletproof protection structure being adapted to cover surfaces or structures with an irregular trend by folding according to the folding lines.

8. The bulletproof protection structure of claim 7, wherein the elementary components are connected with the flexible base only at the raised section.

9. The bulletproof protection structure of claim 8, further comprising connection means adapted to associate the elementary components with the flexible base.

10. The bulletproof protection structure of claim 9, wherein the connection means comprise a plurality of adhesive layers, each adhesive layer covering a raised section of an elementary component.

11. The bulletproof protection structure of claim 7, wherein the flexible base is made of ballistic fabric which comprises fibers selected from high tenacity fibers and high molecular weight polyethylene.

12. A bulletproof vest comprising a flexible base and a reinforcing structure made by means of a ballistic panel associated with the flexible base which form a bulletproof protection structure, wherein the ballistic panel is formed by a plurality of elementary components covering an area to be protected, the ballistic panel being foldable at folding lines housed in free areas made by free surfaces of adjacent elementary components wherein each elementary component comprises:

a prism-shaped body having a first face and a second face of greater extension, which are opposite each other, and a side surface having a first height, and at least one raised section raised from the first face by a second height, wherein the raised section is prism-shaped and has a base area which is less than an area of the first face.

* * * * *